US006145149A

United States Patent [19]

Azumi

[11] Patent Number: 6,145,149

[45] Date of Patent: Nov. 14, 2000

[54] AUTOMATIC FLOOR WASHING APPARATUS

[75] Inventor: Yasuhiro Azumi, Yokohama, Japan

[73] Assignee: Johnson Company, Ltd., Kanagawa, Japan

[21] Appl. No.: 09/117,822

[22] PCT Filed: Feb. 6, 1997

[86] PCT No.: PCT/JP97/00285

§ 371 Date: Dec. 17, 1998

§ 102(e) Date: Dec. 17, 1998

[87] PCT Pub. No.: WO97/28731

PCT Pub. Date: Aug. 14, 1997

[30] Foreign Application Priority Data

Feb. 7, 1996 [JP] Japan ..... 8-045464

[51] Int. Cl.[7] ..... A47L 11/164

[52] U.S. Cl. ..... 15/98; 15/98; 15/50.1; 15/230; 15/97.1

[58] Field of Search ..... 15/97.1, 98, 50.1, 15/230, 244.1, 244.4

[56] References Cited

U.S. PATENT DOCUMENTS

| | | | |
|---|---|---|---|
| 1,461,708 | 7/1923 | Marcello . | |
| 2,039,903 | 5/1936 | Hild | 15/180 |
| 2,893,037 | 7/1959 | Strong . | |
| 3,512,204 | 5/1970 | Jagiel | 15/230 |
| 3,793,665 | 2/1974 | Theilen . | |
| 3,808,753 | 5/1974 | Maran | 51/358 |
| 4,058,936 | 11/1977 | Marton | 51/170 |
| 4,502,174 | 3/1985 | Rones | 15/98 |
| 4,523,411 | 6/1985 | Freerks . | |
| 4,881,288 | 11/1989 | May et al. . | |
| 5,187,827 | 2/1993 | Wei . | |
| 5,311,634 | 5/1994 | Andros . | |
| 5,615,437 | 4/1997 | Takahashi . | |
| 5,778,481 | 7/1998 | Amsden et al. . | |
| 5,966,766 | 10/1999 | Shipley et al. . | |

*Primary Examiner*—Deborah Jones
*Assistant Examiner*—Jennifer McNeil
*Attorney, Agent, or Firm*—Ladas & Parry

[57] ABSTRACT

An automatic floor washing apparatus that washes and polishes the floor at one time with the provision of through holes or apertures for the nonwoven disc pad fixed to a pad base, which is driven by means of a motor at high speeds. With the structure thus arranged, it is possible to reduce the working steps significantly unlike the conventional cleaning operation where the floor washing and polishing is carried out by separate machines, a floor washing apparatus and a high-speed polisher, individually.

3 Claims, 3 Drawing Sheets

AUTOMATIC FLOOR WASHING APPARATUS

TECHNICAL FIELD

The present invention relates to an automatic floor washing apparatus. More particularly, the invention relates to an automatic floor washing apparatus capable of washing and polishing the floor at a time.

BACKGROUND ART

In order to keep the floor of a building or the like clean, the periodical washing and polishing are needed therefor. Conventionally, there have been executed the washing and polishing by use of an automatic floor washing apparatus and a high-speed polisher.

In other words, dirt on the floor is removed by use of a washing apparatus, at first. The washing apparatus has a mechanism such as to rotate a pad or a brush at high speeds. FIGS. 3A and 3B are views which illustrate one example of the conventional washing apparatus. FIG. 3A is a front view and FIG. 3B is a plan view thereof, respectively. As shown in FIGS. 3A and 3B, a nonwoven coarse disc pad 3 is installed on a pad base 2 coupled to a motor 1. On the pad base 2, one or more holes 5 are provided for supplying rinsing water. To wash the floor 4, the pad is closely placed on the floor 4, and rotated at 200 to 300 rpm, while supplying rinsing water from the upper face of the pad base 2. Since the pad is coarse, the rinsing water is allowed to pass inside the pad freely through the holes 5 of the pad base, and enter between the floor and the pad. Then, when washing is completed, the floor is polished by use of a high speed polisher. The so-called buffing is executed to regain the luster thereof. The high-speed polisher uses a disc pad similar to the one for use of washing, but at much higher speeds of 1,500 to 2,500 rpm. Unlike washing, the buffing does not use rinsing water. It polishes the floor in the dry. As a result, much greater friction is obtainable than washing, thus producing an effect that the luster of the floor is regained by the application of such friction.

For the conventional floor washing, there is a problem that two individual machines should be used separately as described above. For the execution thereof, two operations, washing and buffing, should be carried out separately as a matter of course.

As means to solve this problem, it is conceivable that the buffing function is provided for a washing apparatus or, on the contrary, the washing function is provided for a polisher. However, since the pad used for a washing apparatus should be coarse, which exerts small friction, it does not provide any function good enough for buffing, making it impossible to regain the luster of the floor even after it is polished. If use of a fine pad is intended for obtaining large friction with the floor in order to produce an effect required for regaining the luster, while washing the floor, it becomes impossible to supply rinsing water between the pad and the floor, because the rinsing water cannot pass inside such fine pad.

DISCLOSURE OF INVENTION

With a view to solving the problem described above, the present invention is designed. It is an object of the invention to provide an automatic floor washing apparatus capable of executing the floor washing and buffing at one time.

In other words, a first invention hereof is an automatic floor washing apparatus having a nonwoven disc pad fixed to a pad base rotatively at high speeds, this pad being provided with through holes for supplying rinsing water. A second invention hereof is an automatic floor washing apparatus having a nonwoven disc pad fixed to a pad base rotatively at high speeds, this pad being provided with apertures open to the side and bottom faces thereof for drawing in rinsing water.

DETAILED DESCRIPTION OF THE PREFERRED EMBODIMENTS

Hereinafter, with reference to the accompanying drawings, the present invention will be described in detail.

Figure 1A:
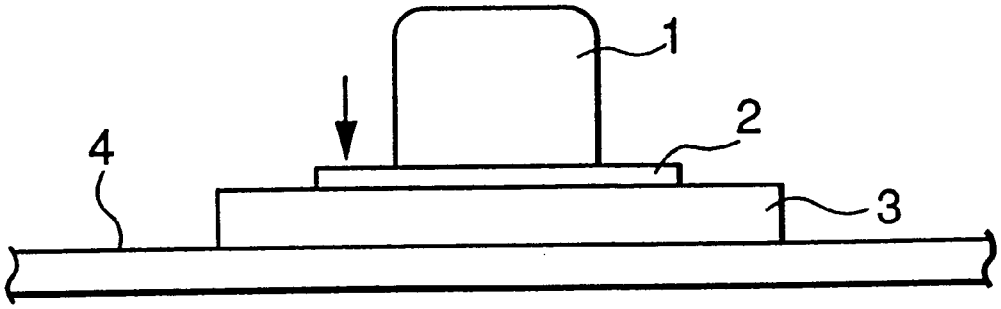
FIGS. 1A and 1B are views which illustrate one example of the automatic floor washing apparatus in accordance with a first invention hereof.
Figure 1B:
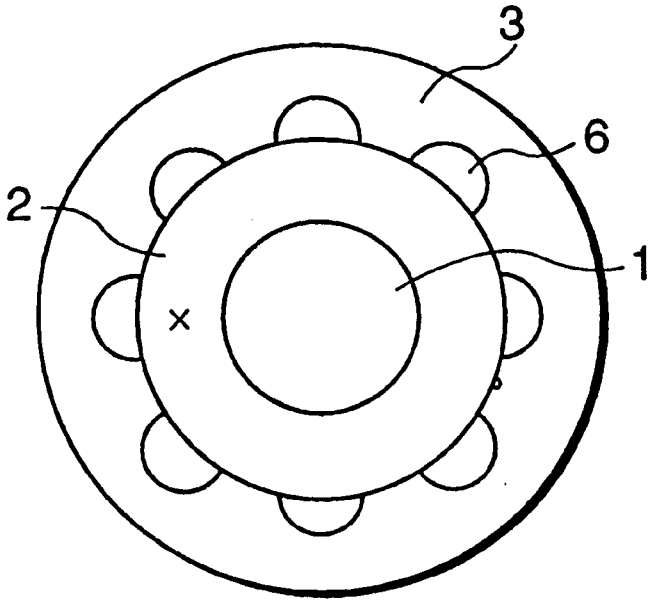

FIGS. 1A and 1B are views which illustrate one mode of the automatic washing apparatus in accordance with a first invention hereof. FIG. 1A is a front view and FIG. 1B is a plan view thereof, respectively.

To a motor 1 for use of rotation, a thin metallic disc pad base 2 is coupled. To the pad base 2, a fine nonwoven pad 3 is fixed. The pad 3 is a disc whose diameter is slightly larger than that of the pad base 2. The pad is provided with through holes 6 slightly toward its outer circumference, which pass through the pad vertically for supplying rinsing water. Each of the upper apertures of the through holes 6 is partly covered by the pad base 2, but not totally covered thereby.

For washing and buffing, the pad is rotated at a high speed of 1,500 to 2,500 rpm, for example, to exert friction with the floor, while supplying rinsing water to appropriate locations on the pad base 2, such as indicated by an arrow in FIG. 1A (the location designated by a mark X in FIG. 1B). The rinsing water supplied to the pad base splashes outwardly by means of centrifugal force and flows into the through holes 6, hence being supplied to the floor.

Figure 2A:
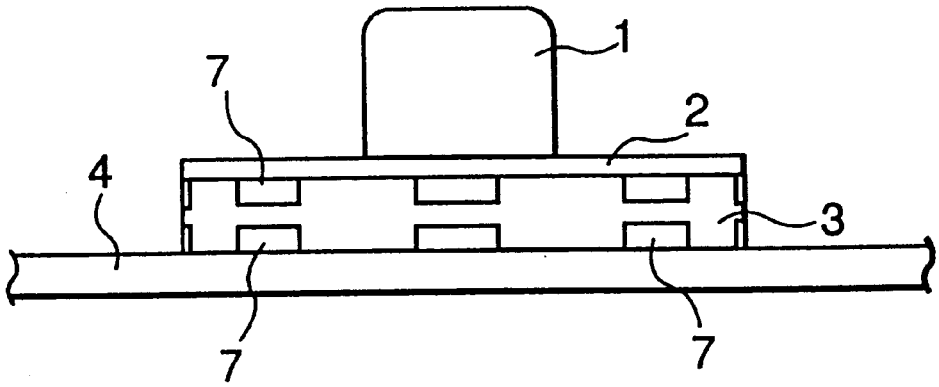
FIGS. 2A and 2B are views which illustrate one example of the automatic floor washing apparatus in accordance with a second invention hereof.
Figure 2B:
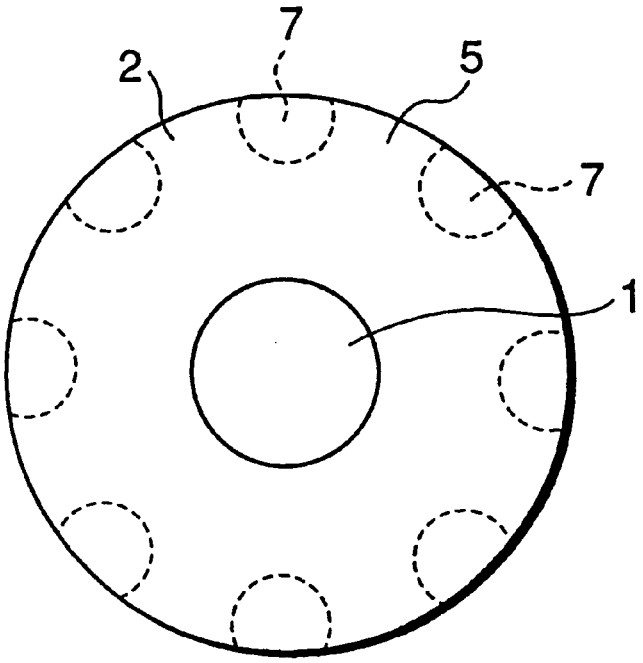
Figure 3A:
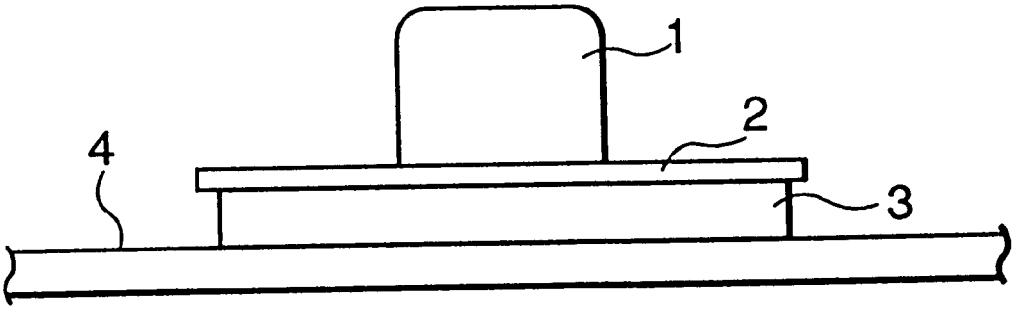
FIG. 3A (PRIOR ART)
FIGS. 3A and 3B are views which illustrate one example of the conventional automatic floor washing apparatus.
Figure 3B:
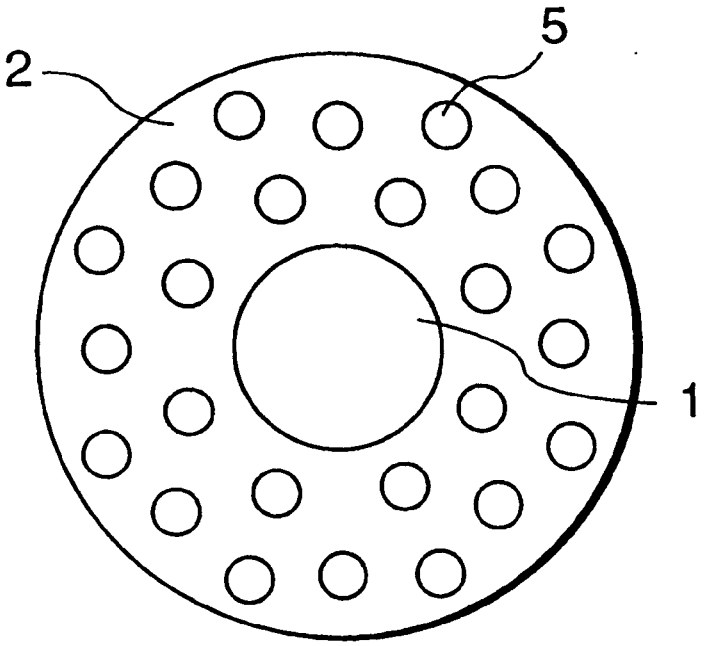
FIG. 3B (PRIOR ART)

FIGS. 2A and 2B are views which illustrate one mode of the automatic washing apparatus in accordance with a second invention hereof. FIG. 2A is a front view and FIG. 2B is a plan view thereof, respectively.

In the mode shown in FIGS. 2A and 2B, the disc pad 3 fixed to the pad base 2 is provided with apertures 7 for use of drawing in rinsing water. In this case, there is no need for the diameter of the pad base 2 to be made smaller than that of the pad 3. It may be substantially the same or slightly larger than the latter. There is no particular restriction on it. Each of the apertures 7 is open to the side face of the pad and to the floor. While rinsing water is applied over to the floor in advance or while it is being applied thereto, the pad is caused to rotate. Then, the rinsing water on the floor is drawn into the apertures 7 and supplied to the friction surface, thus executing both the washing and buffing.

In accordance with the present invention, the pad is formed by a fine nonwoven disc. The nonwoven material is not necessarily limited. It may be polypropylene, polyethylene, nylon, polyester, acrylic material, or the like. Preferably, it is polyester, denatured polyester, or a thermo-fusing fiber formed by the compound thereof. The thickness and length of the fiber are not necessarily limited. It should be good enough if only these are appropriately selected to meet the purpose. Usually, there are in use those having the fabric diameter of 20 to 60 $\mu$m, and length of 50 to 80 $\mu$m. The density of a pad is 0.01 g/cm$^3$ or more. If the density is less than 0.01 g/cm$^3$, no polishing function is obtainable when buffing, although it still provide a washing function. Hence, it is impossible to regain the luster of the floor after all. Preferably, the density is 0.01 to 0.1 g/cm$^3$. The thickness of the pad is not necessarily limited, but usually, it is 10 to 100 mm.

For the first invention hereof, the pad is provided with through holes toward its outer circumference for supplying rinsing water to the floor. The number of the through holes is not limited, but usually, it is two or more. The holes are arranged so that the center of the gravity of the pad is substantially equal to that of the disc in order to prevent vibration from being generated when it rotates at high speeds. The configuration of the through holes is not particularly limited. It may be column, square column, or the like. The number, size, configuration, and others can be determined appropriately with respect to the through holes so that rinsing water is supplied to the floor in a sufficient amount when the pad rotates at high speeds.

The pad is fixed to the pad base by an appropriate means such as the application of bonding agent, and then, the base is coupled to a motor, thus making the pad rotative at high speeds. The pad base is usually formed by a thin metal or plastic disc. However, the present invention is not necessarily limited thereto. As shown in FIG. 1, it may be possible for the base to partly cover each upper aperture of through holes provided for the pad, but the size thereof is not allowed to be such as to cover the holes totally so that no rinsing water flows into the through holes. Essentially, it should be good enough if only a pad can be fixed assuredly and the rotation of a motor can be transmitted to the pad, and further, the supplied rinsing water can be conducted into the through holes of the pad.

For the second invention hereof, the pad is provided with apertures for drawing in rinsing water on the floor. These apertures are open to the side face of the pad and to the floor as well. The number of the apertures is not limited, but usually, it is two or more. The apertures are arranged so that the center of the gravity of the pad is substantially equal to that of the disc in order to prevent vibration from being generated when it rotates at high speeds. The configuration of the apertures is not particularly limited. It may be partially circular, oblong, trapezoidal, or the like. The number, size, configuration, and others can be appropriately determined with respect to the apertures so that rinsing water is drawn into them in a sufficient amount when the pad rotates at high speeds. The installation of the pad and others can be executed as in the first invention hereof. As to the size of the pad base, however, there is no restriction such as set forth for the first invention.

In this respect, the apertures can be arranged both on the upper and lower faces of the pad as shown in FIGS. 2A and 2B. In this case, the upper apertures have no particular significance with respect to washing and buffing. However, when the one side of the pad is worn out, it is possible to use the pad invertedly so as to prolong the life thereof.

In accordance with the present invention, since a fine nonwoven material is used for the pad of an automatic floor washing apparatus, it is made possible to obtain the luster of the floor by the application of buffing effect. Conventionally, it is impossible to wash the floor by use of any fine buff, because rinsing water cannot pass inside the pad, and no rinsing water is supplied to the floor as required. For the present invention, the pad is provided with through holes or apertures to supply rinsing water to sufficiently supply rinsing water to the friction surface of the floor. As a result, by use of the automatic floor washing apparatus of the present invention, it is possible to execute washing and polishing by means of buffing with only one machine at a time, thus reducing the working steps significantly.

What is claimed is:

1. An automatic floor washing and polishing apparatus comprising a nonwoven disc pad, said pad having a density of at least 0.01 g/cm$^3$ and being fixed to a pad base, said pad having a perimeter, said pad having a side face at the perimeter and being provided with through holes for supplying rinsing water to the surface of the floor.

2. An automatic floor washing and polishing apparatus comprising a nonwoven disc pad fixed to a pad base, said pad having a perimeter and a side face at the perimeter, said pad being provided with apertures open to said side face of said pad and to the floor for drawing in rinsing water.

3. An automatic floor washing and polishing apparatus according to claim 1 or claim 2, wherein the density of said pad is 0.01 to 0.1 g/cm$^3$.

* * * * *